US005881025A

United States Patent [19]

Murakami

[11] Patent Number: 5,881,025

[45] **Date of Patent: *Mar. 9, 1999**

[54] INFORMATION DISPLAY APPARATUS

[75] Inventor: Akiyoshi Murakami, Tanashi, Japan

[73] Assignee: Citizen Watch Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 655,009

[22] Filed: May 29, 1996

[30] Foreign Application Priority Data

Jun. 2, 1995 [JP] Japan ..... 7-136402

[51] Int. Cl.[6] ..... G04B 18/00; G04B 23/02

[52] U.S. Cl. ..... 368/74; 368/185; 368/243; 368/244; 368/223

[58] Field of Search ..... 368/72, 73, 74, 368/243, 244, 250, 185, 190

[56] References Cited

U.S. PATENT DOCUMENTS 4,652,140 3/1987 Nakazawa ..... 368/74
5,479,379 12/1995 tsuchiya et al. ..... 368/74

*Primary Examiner*—Bernard Roskoski
*Attorney, Agent, or Firm*—Greer, Burns, & Crain Ltd.

[57] ABSTRACT

An information display apparatus is provided which has a first display means that displays a first information and a second display means that displays either the first information or second information that differs from the first information, an annunciating means which externally annunciates this condition based on a prescribed signal, when the second display means is displaying the second information, if the second information coincides with the first information being displayed by the first display means, and a switching means to enable selection of at least one of selection, changing, or repeated selection of one of the first information and the second information displayed to be displayed by the second display means.

12 Claims, 8 Drawing Sheets

INFORMATION DISPLAY APPARATUS

BACKGROUND OF THE INVENTION

1. Field of the Invention

The present invention relates to an information display apparatus having a plurality of information display sections, and more specifically it relates to an electronic watch having a plurality of information display sections.

2. Description of the Related Art

There have been a variety of information display apparatuses proposed for the individual for the arbitrary display of a plurality of types of information. One of these is the information display apparatus which was disclosed by the inventor himself in the form of a specific configuration in the Japanese Unexamined Patent Publication (KOKAI) No. 6-86148.

This information display device was shown as the example of an electronic watch, one time of information displayed by the watch being the current time, and another type of information being displayed by the watch being the alarm time.

The configuration and the functioning of a prior art information display apparatus will be explained below, using the example of the above-noted information display apparatus, with reference being made to FIG. 7.

FIG. 7 is a circuit block diagram of an electronic watch in the prior art having a plurality of time-displaying means, in which the reference numeral 1 denotes an oscillator circuit which generates a reference signal, 2 denoting a frequency-dividing circuit which divides the signal of the oscillator circuit 1.

In this drawing, the reference numeral 3 denotes a first wave-shaping circuit which, using the reference signal from the frequency-dividing circuit 2, generates a motor-drive signal, 4 is a first motor-driving circuit for the purpose of driving a first motor using the signal of the first wave-shaping circuit 3, 5 is a first motor which is driven by the first motor-driving circuit 4, 6 is a set of first indicating hands which is moved by the first motor 5, this set of first indicating hands corresponding to the first display means.

In this same FIG. 7, the reference numeral 7 denotes a second wave-shaping circuit which, using the reference signal from the frequency-dividing circuit 2, generates a motor-drive signal, 8 is a second motor-driving circuit for the purpose of driving a second motor using the signal of the second wave-shaping circuit 7, 9 is a second motor which is driven by the second motor-driving circuit 8, 10 is a set of second indicating hands, this set of second indicating hands corresponding to the second display means.

In the same FIG. 7, the reference numeral 11 denotes a first counter which measures a number of rotations of the first motor, 12 is a second counter which measures a number of rotations of the second motor, 13 is a first coincidence-detecting circuit for the purpose of detecting coincidence between the first counter 11 and the second counter 12, this first coincidence-detecting circuit outputting a high-level signal for the coincidence condition and a low-level signal for a different condition than coincidence.

In the same FIG. 7, reference numeral 14 denotes a first switch for the purpose of setting an alarm, 15 is a one-step advance detection circuit which detects that a one-step advance operation has been made by the first switch 14, and 16 is a fast-advance detection circuit which detects that a fast-advance operation has been made by the first switch 14.

In the same FIG. 7, reference numeral 17 denotes an alarm-control circuit which controls the setting and resetting of the alarm, and 18 denotes an alarm means which generates a sound.

Next, the operation of a prior art electronic watch having a plurality of time-displaying means will be described, with reference being made to FIG. 7, FIG. 8, and FIG. 9.

First, as an initialization, it is necessary to cause coincidence between the indication of the set of first indicating hands 6 and the set of second indicating hands.

The first set of indicating hands 6 is usually set to the time, for example, by pulling the stem 40 outward and turning it, in the same manner as with a conventional watch.

The second set of indicating hands 10 is set to the same time as the first set of indicating hands 6 by pressing the first switch 14 when the stem 40 is in the pulled-out position.

If the stem 40 is returned to its original position with the indications of the first set of indicating hands 6 and the second set of indicating hands 10 in coincidence, the first set of indicating hands 6 and the second set of indicating hands 10 begin to move as in a conventional watch.

Simultaneous with the above starting, the first counter 11 and the second counter 12 are reset, and begin to measure the number of times the indicating hands have advanced since the stem 40 was returned to its normal position.

Still simultaneously with the above starting, the coincidence-detecting circuit 13 detects coincidence between the first counter 11 and the second counter 12, and outputs a high-level signal.

The alarm-control circuit 17 is configured so as to be reset by the falling signal of the coincidence-detecting circuit 13, and further so as to drive the alarm circuit 18 in accordance with the rising signal of the coincidence-detecting circuit 13, and at this point has not yet been set, so that the alarm circuit 18 is not driven by the rising signal.

FIG. 8 is an outer view of the electronic watch in this condition. Next, the case of setting the second set of indicating hands 10 to an alarm time will be described.

When the first switch 14 is pressed for a short period of time, the one-step advance detection circuit 15 operates, a signal being output to the second wave-shaping circuit 7. The second wave-shaping circuit 7 receives the above-noted signal, thereby causing the second counter 12 to advance by one step, and outputting a pulse to the second motor-driving circuit 8. The second motor-driving circuit 8 receives this pulse and causes the second set of indicating hands 10 to move by one step, by causing the second motor 9 to rotate.

If at this point the first switch 14 is continued to be pressed, the fast-advance detection circuit 16 operates, the above-noted second set of indicating hands 10 as well as the second counter 12 being caused to fast-advance.

In this manner, it is possible to set the second set of indicating hands 10 to the alarm time.

In doing this, because the second counter 12 only is counting up, the coincidence-detecting circuit L3 does not output a coincidence detection signal.

The alarm-control circuit 17 is set by the falling signal of the coincidence-detecting circuit 13. When the alarm-control circuit 17 is set, the second wave-shaping circuit 7 stops its theretofore normal hand-driving signal output, so that the second set of indicating hands 10 stops at that position.

FIG. 9 is an outer view of the electronic watch in the above-noted condition.

After this, when time elapses so that the first set of indicating hands 6 and second set of indicating hands 10 coincide, the first counter 11 and the second counter 12 coincide, and coincidence-detecting circuit 13 detects the coincidence between these two counters and outputs a rising signal.

The alarm-control circuit 17 operates when it receives this rising signal, thereby operating the alarm circuit to sound the alarm.

When the alarm is sounded, the second wave-shaping circuit 7 starts to output a signal once again, the first set of indicating hands 6 and the second set of indicating hands 10 continuing to indicate the same time.

If it is desired to cancel an alarm from the set condition, when the first switch 14 is operated to cause coincidence between the second set of indicating hands 10 and the first set of indicating hands 6, the first counter 11 and the second counter 12 coincide, the coincidence-detecting circuit 13 detects this coincidence, so that the alarm-control circuit 17 is reset, thereby canceling the alarm.

When the alarm is canceled, the second set of indicating hands 10 and the first set of indicating hands 6 continue to indicate the same time.

In this manner, the drive of the hands is continued with coincidence between the first set of indicating hands 6 and the second set of indicating hands 10 being maintained, the first switch 14 being then used to set the second set of indicating hands 10 to a time that is different from the first set of indicating hands 6 to set the alarm, the second set of indicating hands 10 at that point stopping drive to indicate the time, after which when the indication of the first set of indicating hands 6 coincides with the indication of the second set of indicating hands 10 an alarm is sounded, after which the first set of indicating hands 6 and the second set of indicating hands 10 are driven as in the coinciding condition.

Cancellation of the alarm is done by the first switch 14, which causes coincidence between the indications of the second set of indicating hands 10 and the first set of indicating hands 6.

In the above-noted electronic watch, after the alarm is set, when the first set of indicating hands 6 and the second set of indicating hands 10 coincide and the alarm is sounded, because the second set of indicating hands 10 and the first set of indicating hands 6 thereafter both continue to indicate the current time, the alarm does not sound again, which is a very convenient feature when using the watch as a timer.

However, after this alarm is set, when the alarm should be cancelled, it was necessary to perform fast advance continuously until the second set of indicating hands 10 and first set of indicating hands 6 concides. This was not only troublesome, but was also accompanied by the risk of overrun.

Furthermore, if the same time was to be set as the alarm after it sounded, the same fast-advance operation as mentioned had to be performed.

To remedy the above-noted situation, the Japanese Unexamined Patent Publication (KOKAI) No. 2-25791 discloses technology for stopping the alarm setting fast-advance correction during fast-advance operation when the alarm hands and the hands indicating the current time coincide, thus preventing overrun.

Further, in the above-noted patent publication, after the current time and the alarm time coincide and the alarm is sounded, there are two alarm modes, an alarm mode A in which the alarm remains in the un-set condition after the alarm has sounded, and an alarm mode B in which the alarm is not canceled even after the alarm has sounded, so that when the current time and the alarm time coincide again the alarm is sounded, these alarm modes being selectable for use by switching therebetween.

However, even in the disclosure in the above-noted patent publication, once an alarm time is set, to cancel the time it is still necessary to continuously perform a switch operation until coincidence is reached.

SUMMARY OF THE INVENTION

In consideration of the above-noted drawbacks in the prior art, an object of the present invention is to provide an information display apparatus which solves the above-noted drawbacks in the prior art and, with a simple configuration, either causes information which is displayed on one of a first display means and a second display means to be either the same as or different from the information which is displayed on the other of the first display means and the second display means and which is capable of easy resetting and or cancellation of the setting operation of the above-noted information. More specifically, an object of the present invention is to provide an electronic watch which has a configuration that is simpler than the configuration of electronic watches in the past and which is capable of easy cancellation and resetting of the alarm function.

To achieve the above-noted object, the present invention uses the following basic technical constitution described below.

Specifically, the present invention is an information display apparatus having a first display means that displays a first information, a second display means that displays one of either said first information or a second information, said second information being different from said first information, an annunciation means which, in the case in which said second display means is displaying said second information, performs external annunciation based on a predetermined signal for the condition in which the second information coincides with the first information which is displayed by said first display means, and a switching means which minimally causes the second display means to execute one of selection, changing, or repeated selection of one of the first information and the second information to be displayed by said second display means.

A specific example of an information display apparatus as described above is a watch. Specifically, there are electronic watches, and in present invention the first information is the current time and the second information is the alarm information.

DETAILED DESCRIPTION OF THE INVENTION

The constitution, functions, and operation of an information display apparatus according to the present invention will be described in detail, this description focusing on the specific example of an electronic watch.

Figure 1:
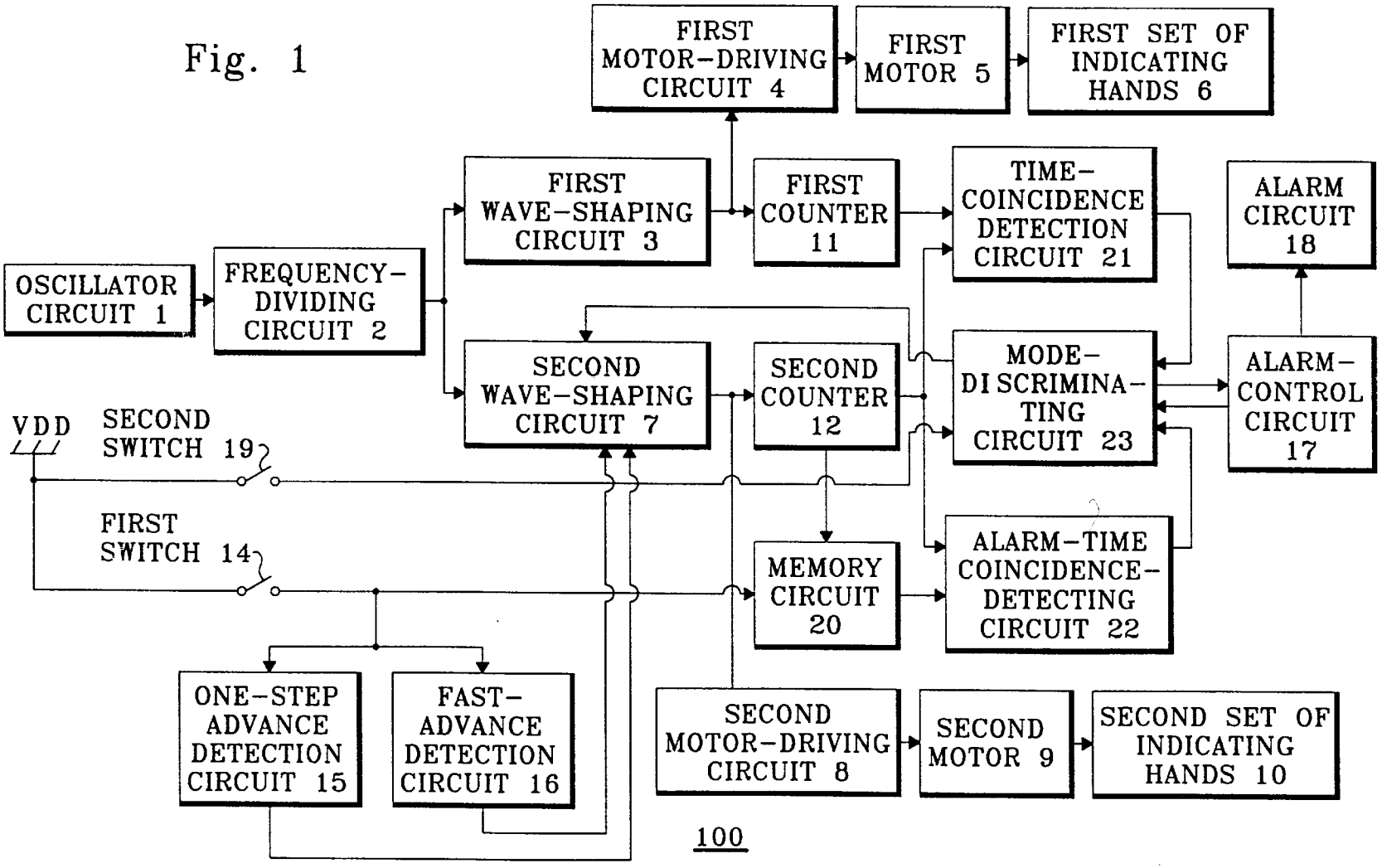
FIG. 1 is a circuit block diagram of an electronic watch, which shows an embodiment of an information display apparatus according to the present invention.

FIG. 1 is a block diagram which shows in simplified form the configuration of an electronic watch as a specific example of an information display apparatus 100 according to the present invention, the information display apparatus 100 in this drawing having a first display means 6 which displays a first information, a second display means 10 which displays the either the first information or a second information, which is different from the first information, an annunciation means 18 which, when the second display means 10 is displaying the above-noted second information performs to announce externally a condition in which the second information displayed by the second display means 10 coincides with the first information being displayed by the first display means 6, by means of a pre-established signal and a switching means 19 which causes the above-noted second display means 10 to execute one operation of selecting, changing, and repeatedly selecting either the first or second information to be displayed on the above-noted second display means 10.

In the information display apparatus 100 according to the present invention, while there is no particular limitation imposed with regard to the first information and the second information, the first information is preferably, for example, the current time, and the second information is preferably, for example, the alarm information.

That is, a preferred embodiment of the information display apparatus 100 according to the present invention is an electronic watch capable of displaying the above-noted information.

The preferred technical constitution of the information display apparatus 100 according to the present invention will be described below, using the preferred embodiment of an electronic watch.

As shown in FIG. 1, an electronic watch according to the present invention has a first display means 6 which displays the current time, this being the first information, a first counter 11 which is operatively linked to the first display means 6, a second display means 10 which displays either the current time or the alarm time, the latter of which is the second information, a second counter 12 which is operatively linked to the second display means 10, a time-coincidence detection circuit 21 which detects coincidence between the above-noted first counter 11 and the above-noted second counter 12, and an alarm-control means 17 which causes an alarm circuit 18 to operate when by means of a detection signal from the time-coincidence detection circuit 21.

This electronic watch also includes a memory circuit 20 which stores the contents of the second counter 12 when the second display means 10 is displaying the alarm time, an alarm-time coincidence-detecting circuit 22 which detects coincidence between the contents of the second counter 12 and the memory circuit 20, and a mode-discriminating circuit 23 which is controlled by the time-coincidence detection circuit 21, the alarm-time coincidence-detecting circuit 22, and a second switch 19, which is an external switch.

Specifically, in an information display apparatus 100, according to the present invention, it is desirable to have the above-noted information-coincidence detection circuit, for example, time-coincidence detection circuit 21 which judges whether or not there is coincidence between the first information and the second information, and it is further desirable to have the detection circuit 22 which detects coincidence between the contents of the memory means 20, into which storage of the second information is done in accordance with a prescribed command signal, and the second information.

In addition, a feature of the information display apparatus 100 according to the present invention is that, as described above, it has a mode-selecting switch 19, which is an external switch and an information-coincidence detection means 21 which makes a judgment with regard to coincidence between the first information and the second information, and further has a detection circuit 22 which detects coincidence between the second information and the contents of the memory means 20, thus enabling arbitrary selection of setting operation, canceling operation and repeating operation of the setting operation, so as to have the second information coincided or not coincided with the first information.

What follows is a detailed description of the use and operation of an example of the above-noted present invention, with reference made to appropriate accompanying drawings.

Figure 7:
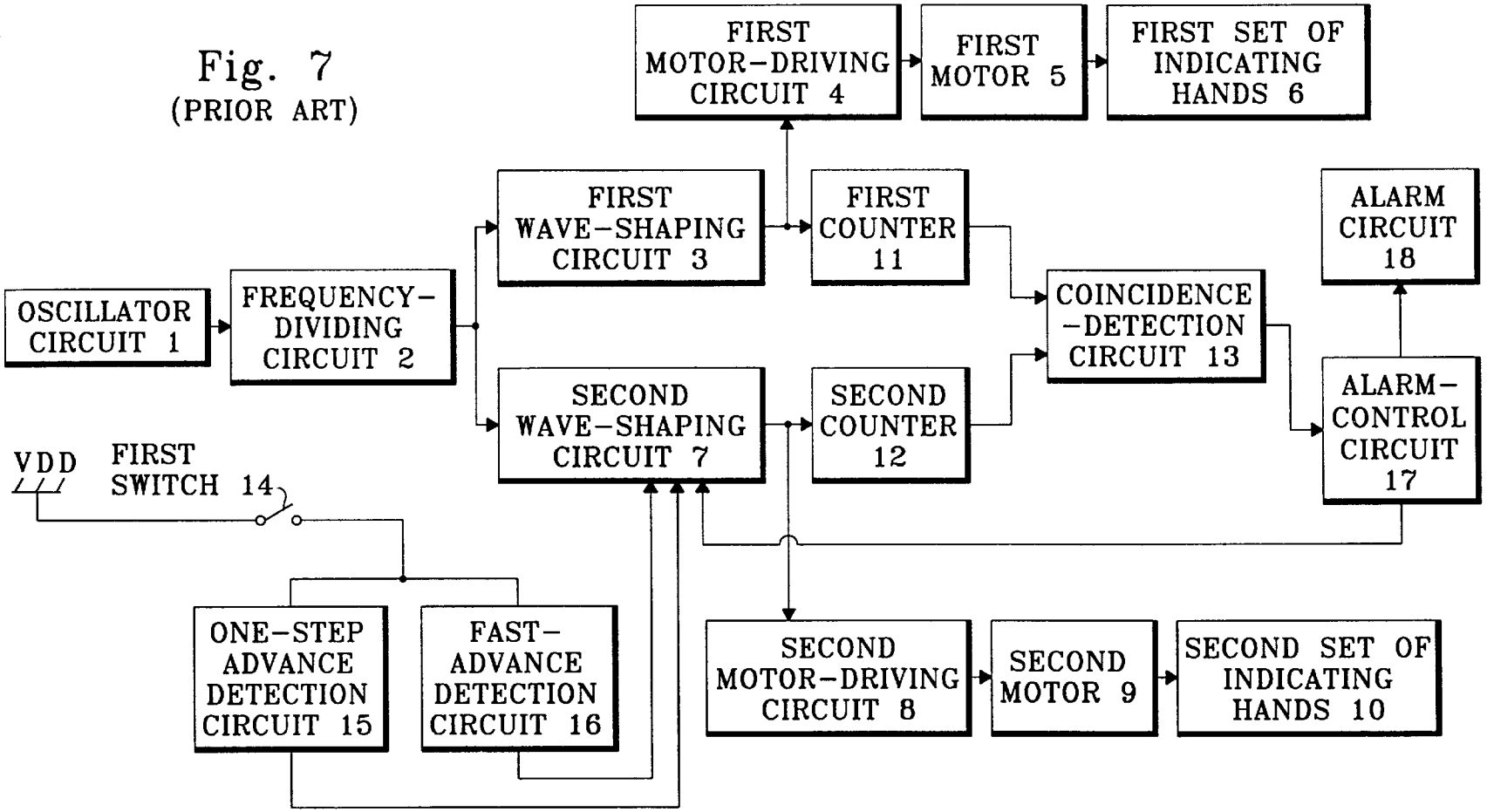
Fig. 7 (PRIOR ART)
FIG. 7 is a circuit block diagram which shows a prior art electronic watch having a plurality of time-displaying means.
Figure 8:
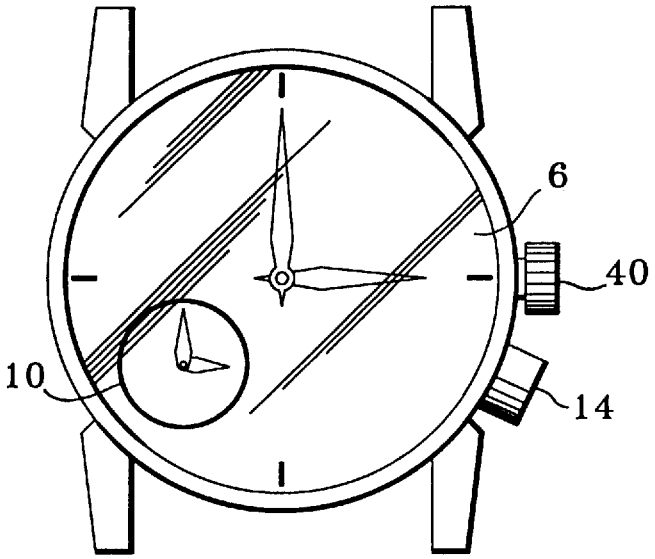
Fig. 8 (PRIOR ART)
FIG. 8 is an outer view of an electronic watch having a plurality of time-displaying means.
Figure 9:
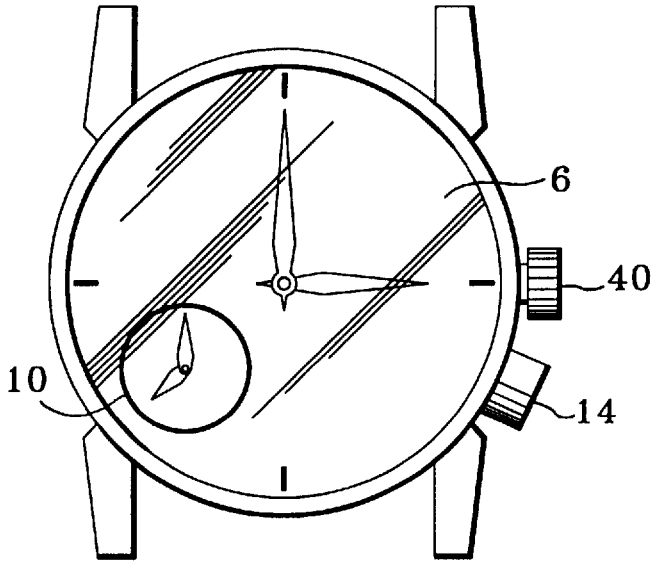
Fig. 9 (PRIOR ART)
FIG. 9 is an outer view of an electronic watch having a plurality of time-displaying means.

In FIG. 1, elements which are the same as those shown in FIG. 7 have been assigned the same reference numerals as in FIG. 7 and will not be explicitly described herein.

In FIG. 1, the reference numeral 19 denotes a second switch for the purpose of changing the display mode concerning the second set of indicating hands, 20 is a memory circuit for the purpose of storing the contents of the second counter 12, 21 is a time-coincidence detection circuit which outputs a coincidence detection signal during the period of time in which the first counter 11 and the second counter 12 coincide to each other, 22 is an alarm-time coincidence-detecting circuit which outputs a signal during the period of time in which the second counter 12 and the contents of the memory circuit 20 coincide, and 23 is a mode-discriminating circuit which makes a judgment as to whether the displayed contents of the second set of indicating hands 10 is the current time or the alarm setting time.

Figure 2:
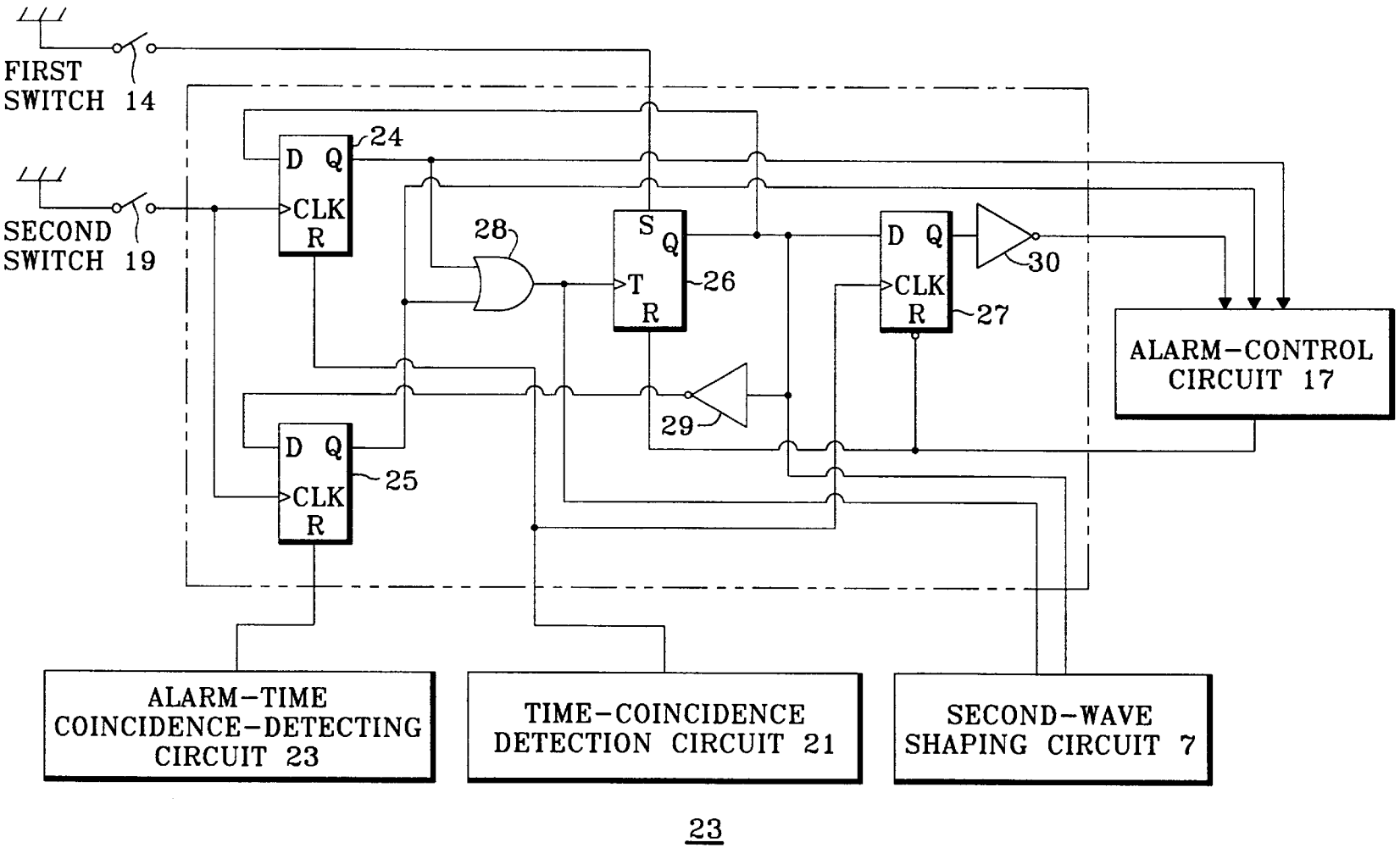
FIG. 2 is a diagram showing the configuration of a mode-discriminating circuit of the electronic watch, which shows an embodiment of an information display apparatus according to the present invention.

FIG. 2 is a drawing showing the configuration of the mode-discriminating circuit 23, In this drawing, 24, 25, and 27 are data-type (D-type) flip-flops (D-F/F) which are triggered on the rising edge of a signal, 26 is a T-type (toggle-type) flip-flop (T-F/F) which is triggered on the falling edge of a signal, 28 is an OR gate, and 29 and 30 are inverters.

An embodiment of the present invention will now be explained, with reference made to FIGS. 1 through 6.

Figure 3:
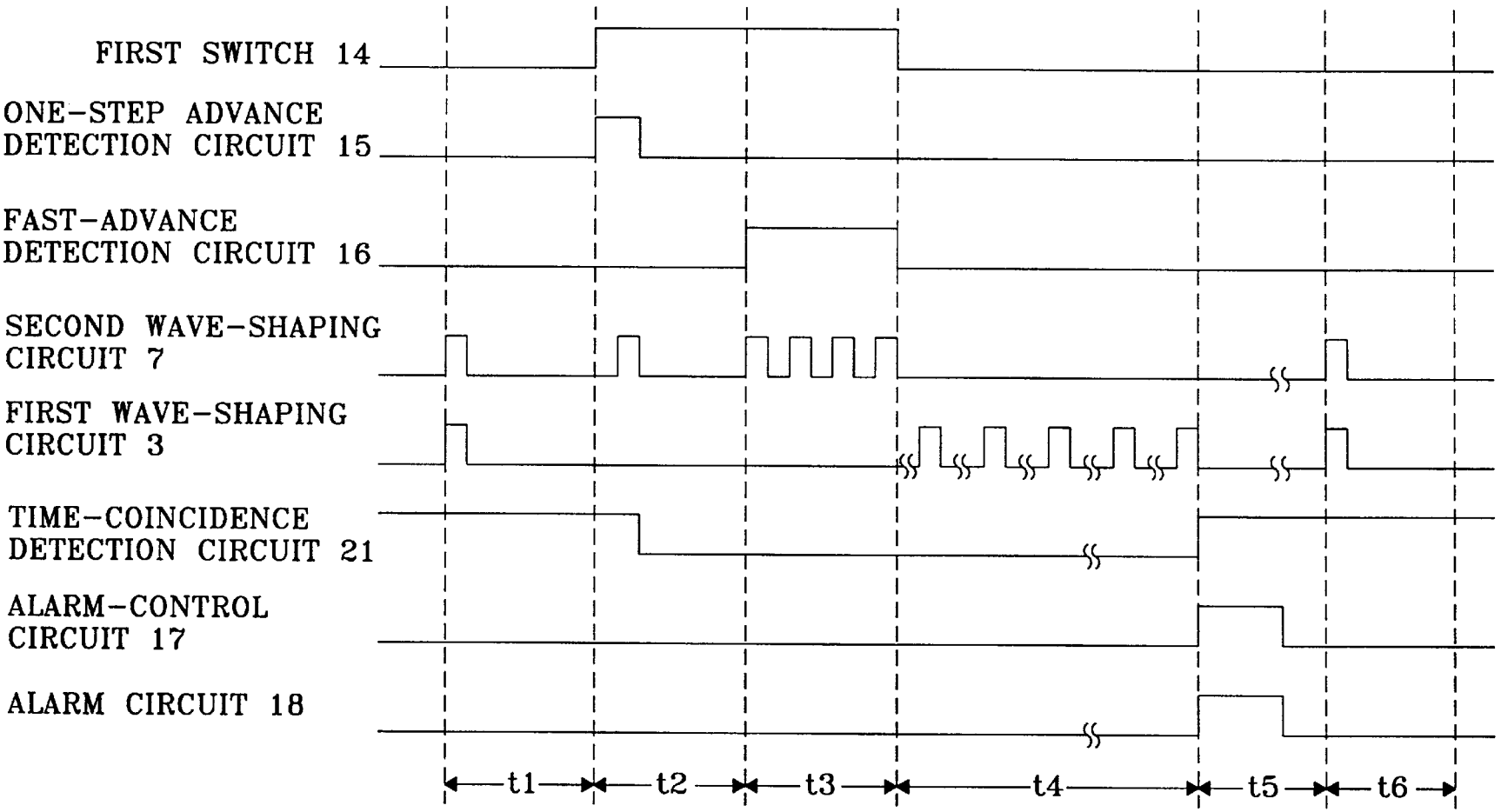
FIG. 3 is a timing diagram of the circuit of an electronic watch that is an embodiment of the present invention.
Figure 4:
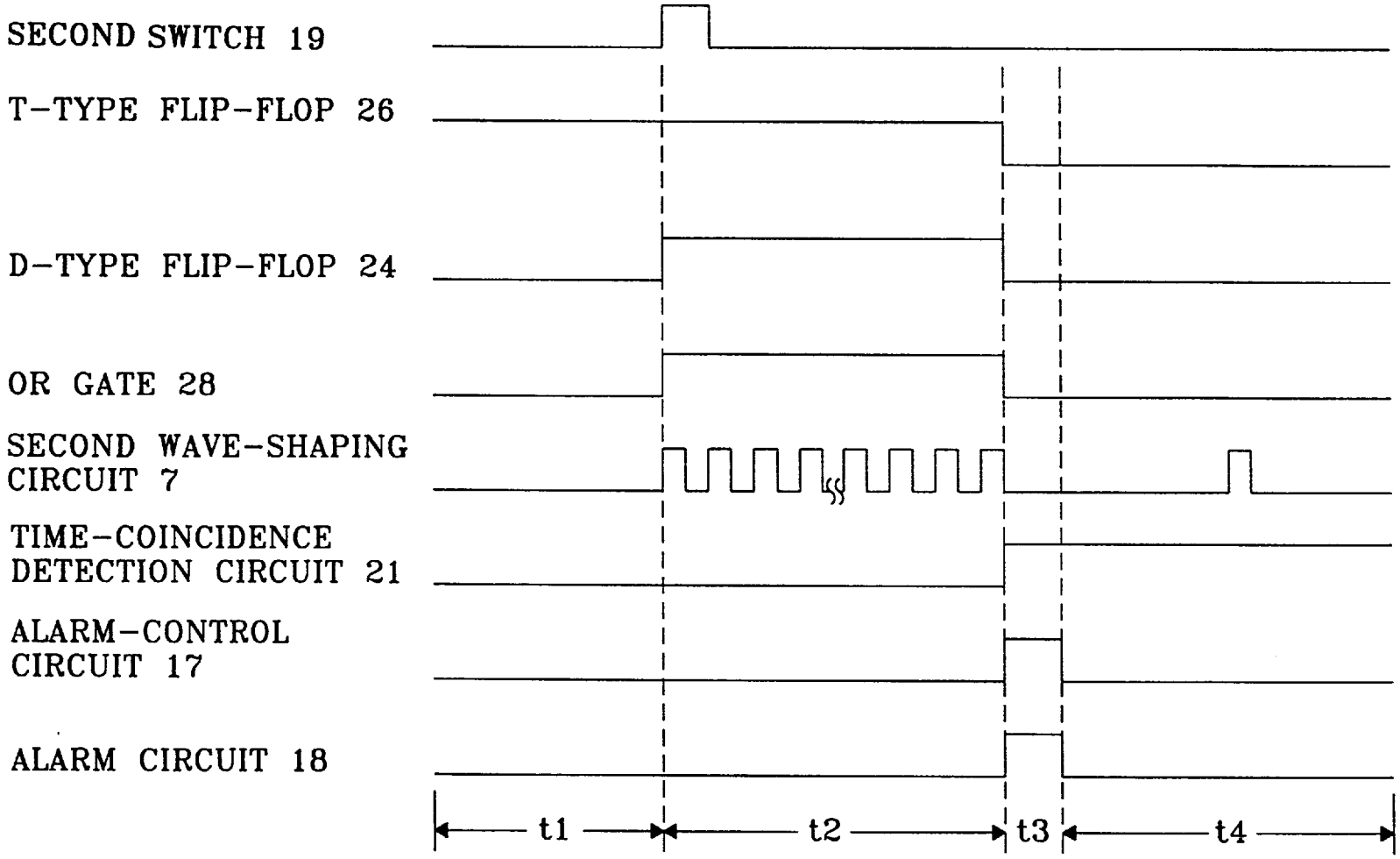
FIG. 4 is a timing diagram of the circuit of an electronic watch that is an embodiment of the present invention.
Figure 5:
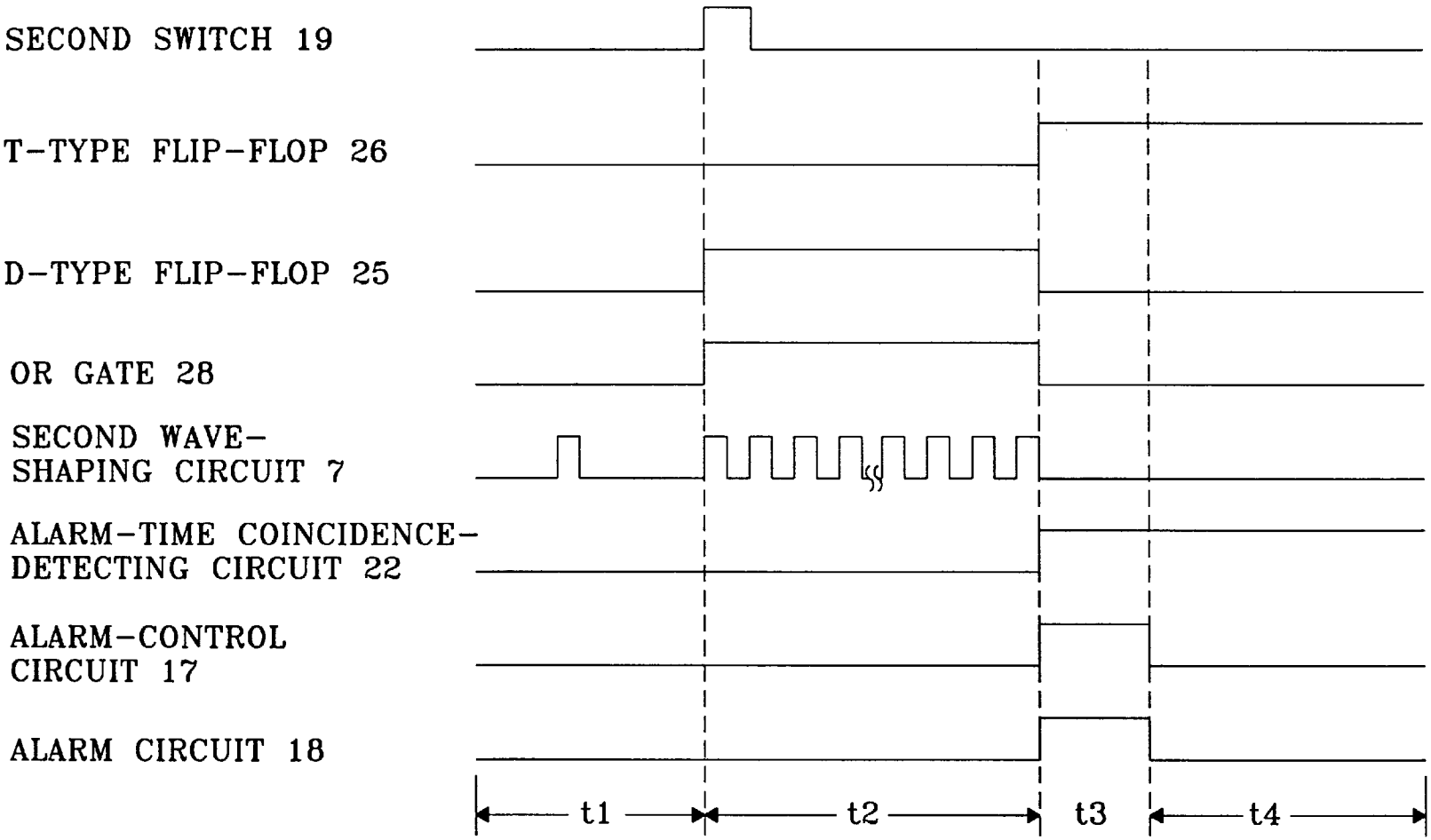
FIG. 5 is a timing diagram of the circuit of an electronic watch that is an embodiment of the present invention.
Figure 6:
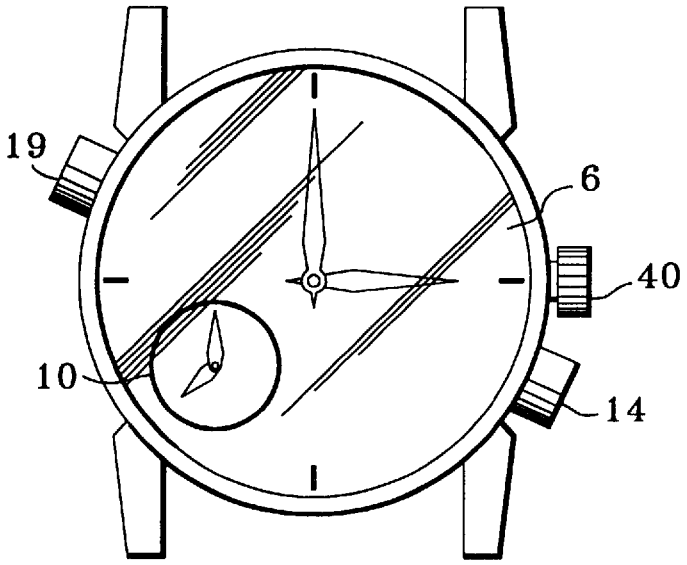
FIG. 6 is an outer view of an electronic watch which shows an embodiment of the present invention.

FIG. 3 is a timing diagram which shows the normal operation of setting an alarm, FIG. 4 is another timing diagram, which show the operation of canceling an alarm setting, FIG. 5 is a timing diagram which shows the alarm-repeat operation, and FIG. 6 is an outer view of the embodiment when setting an alarm.

First, the case in which the second set of indicating hands is set to the alarm time will be described. In the time period t1 in FIG. 3, the condition shown is the one in which both the first set of indicating hands 6 and the second set of indicating hands 10 have been advanced with unit of one minute.

If the first switch 14 is pressed for a short period of time, the one-step advance detection circuit 15 operates, thereby outputting a signal to the second wave-shaping circuit 7.

The second wave-shaping circuit 7 receives this signal, and in response advances the second counter 12 by one step and outputs a pulse to the second motor-driving circuit 8.

The second motor-driving circuit 8 receives this pulse and responds by causing the second motor 9 to rotate, thereby advancing the second set of indicating hands 10 by one step.

Simultaneous with this, if the first switch 14 is operated even one time, the T-type flip-flop (T-F/F) 26 is set, resulting in the Q output thereof becoming high, the mode-discriminating circuit 23 showing thereby the alarm mode. This condition is shown in the time period t2 in FIG. 3.

If the above-noted first switch 14 is pressed continuously for a long period of time, the fast-advance detection circuit 16 operates, and in the same manner as described above, the hands and counter are fast-advanced. This condition is shown in the time period t3 in FIG. 3. When the operation of the first switch 14 is terminated, the contents of the second counter 12 at that instant are stored and held in the memory circuit 20.

It is possible in the above-described manner to set the alarm time.

FIG. 6 is an outer view of the electronic watch in this condition.

When the mode-discriminating circuit 23 detects the alarm mode, the second wave-shaping circuit 7 stops its theretofore output of the normal hand-driving signal, and the second set of indicating hands 10 stop at that position, with only the first wave-shaping circuit 3 outputting a signal for advancing the first sets of hands, and only the first set of indicating hands 6 advancing with unit of one minute.

This condition is shown in the time period t4 in FIG. 3.

After this, when time elapses so that there is coincidence between the first set of indicating hands 6 and the second set of indicating hands 10, the time-coincidence detection circuit 21 detects the coincidence between the two counters and outputs a high level signal "H".

The rising edge of the output from this time-coincidence detection circuit 21 causes the D-type flip-flop (D-F/F) 27 to latch the Q output of the T-type flip-flop (T-F/F) 26 the level of which is high level of "H", so that the output of the D-type flip-flop (T-F/F) 27 is high, "H".

The inverter 30 receives this signal and outputs a low-level signal, "L".

The alarm-control circuit 17 receives this falling signal and operates in response thereto, so that the alarm circuit 18 is operated for ten seconds, thereby causing an alarm to be sounded for ten seconds. This condition is shown in the time period t5 in FIG. 3.

When the sounding of the alarm ends, the output of the alarm-control circuit 17 changes to low level, "L", thereby resetting the T-type flip-flop (T-F/F) 26, making the Q output thereof low, "L", which is the normal time mode for the mode-discriminating circuit 23, at which point output of the hand-drive signal is started once again by the second wave-shaping circuit 7, this causing the second set of indicating hands 10 to continue again to display the same time as the first set of indicating hands 6. This condition is shown in time period t6 in FIG. 3.

Next, the case of canceling the alarm function after it is set will be described.

When the second set of indicating hands 10 is displaying the alarm time in the alarm function, that is, when the Q output of the T-type flip-flop (TF/F) 26 is high, the second wave-shaping circuit 7 does not generate a hand-driving signal, so that the second set of indicating hands 10 is not driven. This condition is shown in time period tl in FIG. 4.

In this condition, if the second switch 19 is operated, the rising of the signal from this second switch 19 causes the D-type flip-flop (D-F/F) 24 to latch the Q output, being in high-level, "H", from the T-type flip-flop (T-F/F) 26 making its output high "H", as well.

In response to this, the output of the OR gate 28 changes to high level "H". When the output of the OR gate 28 changes to high level "H", the second wave-shaping circuit 7 starts to output a fast-advance hand-driving signal, resulting in fast-advancing of the second set of indicating hands 10 and simultaneously the second counter 12 is counted up.

This condition is shown in time period t2 in FIG. 4.

When the first set of indicating hands 6 coincides with the second set of indicating hands 10, that is, when there is coincidence between the first counter 11 and the second counter 12, the time-coincidence detection circuit 21 detects this coincidence and outputs a high level signal "H", resulting in resetting of the D-type flip-flop (D-F/F) 24, which causes the Q output thereof to change to low level of "L".

In response to this, the output of the OR gate 28 also changes to low level, "L", the falling edge of which causes the Q output of the T-type flip-flop (T-F/F) 26 to change to low level, "L", placing the mode-discriminating circuit 23 in the normal time mode. When the Q output of the D-type flip-flop (T-F/F) 24 changes to low level of "AL", the alarm-control circuit 17 receives the falling edge of this signal and operates, so that the alarm circuit 18 is operated for one second, thereby sounding the alarm for one second.

When the Q output of the T-type flip-flop (T-F/F) 26 changes to low level of "L", the second wave-shaping circuit 7 starting output of the normal hand-driving signal. This condition is shown in time period t3 in FIG. 4.

The above sequence of operation cancels the alarm function, so that the second set of indicating hands 10 is driven in concert with the indication of the first set of indicating hands 6.

Next, the case of setting a previous alarm time from the condition in which the alarm is not set will be described.

In the condition in which the second set of indicating hands 10 are indicating the time, that is, in the condition in which the Q output of the T-type flip-flop (T-F/F) 26 is at low level of "L", the second wave-shaping circuit 7 performs to output a hand-driving pulse at every one minute, causing both the second set of indicating hands 10 and the first set of indicating hands 6 to advance by a unit of one minute at each time.

This condition is shown in time period t1 in FIG. 5.

In this condition, if the second switch 19 is operated, the rising of the signal from this second switch 19 causes the D-type flip-flop (D-F/F) 25 to latch a high-level signal of "H", arriving from the low-level Q output of the T-type flip-flop (T-F/F) 26 via the inverter 29, which reversing low-level signal "L" into high level signal "H".

In response, the OR gate 28 outputs a high level "H". When the OR gate outputs a high-level signal "H", the second wave-shaping circuit 7 starts to output a fast-advance hand-driving signal, thereby causing fast-advancing of the second set of indicating hands 10 and simultaneously the second counter 12 is counted out. This condition is shown in time period t2 in FIG. 5.

When the second set of indicating hands 10 and the previously set alarm time coincide, that is, when the contents of the second counter 12 and contents of the memory circuit 20 coincide, the alarm-time coincidence-detecting circuit 22 detects this coincidence, and resets the D-type flip-flop (D-F/F) 25, causing the Q output thereof to change to low level of "L".

In response to this, the output of the OR gate 28 also changes to low level of "L", the falling edge of the output thereof causing the Q output of the T-type flip-flop (T-F/F) 26 to change to high level of "H", this being the alarm mode of the mode-discriminating circuit 23.

When the Q output of the D-type flip-flop (D-F/F) 25 changes to low level of "L", the falling edge of the output signal is received by the alarm-control circuit 17, causing operation thereof, this resulting in operation of the alarm circuit 18 for two seconds, which causes the sounding of the alarm for two seconds.

When the Q output of the T-type flip-flop (T-F/F) 26 changes to high level of "H", the second ware-shaping circuit 7 stops outputting the normal hand-driving signal. This condition is shown in time period t3 in FIG. 5.

As mentioned above, the alarm function of the present invention will be repeated and in accordance with the repetition, the above sequence of operations causes stoppage of the hand drive, with the alarm time setting remaining as is.

This condition is shown in time period t4 in FIG. 5.

In the present invention, while the annunciation means 18 can annunciate the prescribed information, which is the reaching of the alarm time, by using a signal that is, for example, audible, visible, or the like, it is particularly desirable that this be an audible signal.

In addition, in the present invention when the switching means 14 and 19 are operated, in the case in which one of the first information and the second information is at minimum selected, changed, or repeatedly selected, it is desirable that the audible signal output from the annunciation means 18 be different from the audible signal which is used in annunciating the reaching of the set alarm time.

In the present invention, in the case in which the second display means is displaying the first information, by operating the second switch 19, until coincidence between the data of the second counter 12 and contents stored in the memory means 20, which is the alarm setting time that is the second information, the second counter 12 and the second set of indicating hands 10, which is the second display means, are operated in fast-advance mode.

Furthermore, in the case in which the second display means is displaying the alarm time, which is the second information, by operating the second switch 19, until the time-coincidence detection circuit 21 detects coincidence between the data of the second counter and the data of the first counter, which is displaying the current time, this being the first information, the second counter 12 and the second set of indicating hands 10, which is the second display means, are operated in fast-advance mode.

As described in detail above, when the alarm function is canceled from the condition in which the alarm is set, it is sufficient to operate a switch just one time, the normal alarm-setting switch being used, with no necessity to achieve coincidence between hands of the watch.

Additionally, when it is desired to sound an alarm at the same time each day, it is sufficient to press the above-noted switch just one time. It is also possible to verify operations made on the watch by means of a sound.

What is claimed is:

1. An information display apparatus which comprises:

first display means for displaying a first information;

second display means for selectively displaying one of said first information and a second information, said second information being different from said first information;

annunciation means which, in the case in which said second display means is displaying said second information, performs external annunciation based on a predetermined signal for the condition in which said second information displayed by said second display means coincides with said first information displayed by said first display means; and switching means for one of setting, canceling and resetting one of said first and said second information to be displayed by said second display means;

wherein said second information becomes an optional information which is different from said first information when said switching means sets said second information;

said second information becomes automatically coincident with said first information and remains coincident with said first information when said switching means cancels said second information; and said second information stops being coincident with said first information and automatically returns to said optional information when said switching means resets said second information.

2. An information display apparatus according to claim 1, further comprising an information-coincidence detection means which performs a judgment with regard to coincidence between said first information and said second information.

3. An information display apparatus according to claim 2, further comprising a memory means into which is stored said second information based on a prescribed command signal.

4. An information display apparatus according to claim 3, wherein said predetermined signal used for the purpose of external annunciating by the annunciating means is an audible signal.

5. An information display apparatus according to claim 4, wherein in the case in which said switching means executes one of said setting, canceling and resetting of said second information, an audible signal is output from said annunciation means, said audible signal being different from said audible signal of said predetermined sidal.

6. An information display apparatus according to claim 5, wherein said audible signals output from said annunciation means when said switching means executes one of said setting, canceling and resetting of said second information, are mutually different from each other, in accordance with an operation executed.

7. An information display apparatus according to claim 6, wherein said information display apparatus is a watch.

8. An information display apparatus according to claim 7, wherein said first information is the current time, and wherein said second information is alarm information.

9. An information display apparatus according to claim 1, wherein said switching means includes a first switch for said setting one of said first information and said second information, and a second switch for said canceling and said resetting one of said first information and said second information.

10. An electronic watch which comprises:

first display means which displays a current time;

a first counter which is operationally linked to said first display means;

second display means which displays one of said current time and an alarm time;

a second counter which is operationally linked to said second display means;

a time-coincidence detection circuit which detects a coincidence between said first counter and said second counter; and an alarm-control circuit which causes a controlled alarm circuit to operate in accordance with a detection signal from said time-coincidence detection circuit;

wherein said second display means displays said alarm time when an alarm is set and said current time after said time-coincidence detection circuit has detected said coincidence between said first and second counters;

said electronic watch further comprising:

a memory circuit into which are stored contents of said second counter when said second display means is displaying said alarm time;

an alarm-time coincidence-detecting circuit which detects a coincidence between said second counter and contents of said memory circuit; and a mode-discriminating circuit which is controlled by said time-coincidence detection circuit, said alarm-time coincidence-detecting circuit, and an external switch;

wherein said second display means stops displaying said current time and automatically displays said alarm time when said alarm-time coincidence-detecting circuit detects said coincidence between said second counter and said contents of said memory circuit; and said second display means stops displaying said alarm time and automatically displays said current time when said external switch is activated and said first counter and said second counter becomes coincide.

11. An electronic watch according to claim 10, wherein when said second display means is displaying said current time, which is a first information, by means of a prescribed command signal, said second counter and said second display means are driven in a fast-advanced mode until said contents of said second counter and said contents stored in said memory circuit, in which a second information is stored, coincide so that said second display means displays said alarm time.

12. An electronic watch according to claim 10, wherein in the case in which said second display means is displaying said alarm time which is a second information, by means of a prescribed command signal, said second counter and second display means are driven in a fast-advance mode until said contents of said second counter and contents of said first counter coincide so that said second display means displays said current time.

* * * * *